US007808357B2

(12) United States Patent
Shyu et al.

(10) Patent No.: US 7,808,357 B2
(45) Date of Patent: Oct. 5, 2010

(54) DUAL INDUCTANCE STRUCTURE

(75) Inventors: Ying-Chieh Shyu, Pusin Township, Changhua County (TW); Pao-Nan Lee, Pingtung (TW); Chi-Han Chen, Cishan Township, Kaohsiung County (TW)

(73) Assignee: Advanced Semiconductor Engineering, Inc., Kaohsiung (TW)

( * ) Notice: Subject to any disclaimer, the term of this patent is extended or adjusted under 35 U.S.C. 154(b) by 0 days.

(21) Appl. No.: 12/427,962

(22) Filed: Apr. 22, 2009

(65) Prior Publication Data

US 2010/0060403 A1 Mar. 11, 2010

Related U.S. Application Data

(60) Provisional application No. 61/136,504, filed on Sep. 10, 2008.

(30) Foreign Application Priority Data

Feb. 11, 2009 (TW) ..... 98104390 A

(51) Int. Cl.
*H01F 5/00* (2006.01)

(52) U.S. Cl. ..... 336/200; 336/223; 336/232

(58) Field of Classification Search ..... 336/200, 336/223, 232

See application file for complete search history.

(56) References Cited

U.S. PATENT DOCUMENTS

| | | | | |
|---|---|---|---|---|
| 6,404,319 | B1 * | 6/2002 | Iida et al. | 336/200 |
| 6,577,219 | B2 | 6/2003 | Visser | |
| 6,798,326 | B2 | 9/2004 | Iida | |
| 7,227,428 | B2 * | 6/2007 | Fukunaga | 333/26 |
| 7,321,284 | B2 * | 1/2008 | Chen et al. | 336/200 |
| 7,518,473 | B2 * | 4/2009 | Ni | 333/238 |
| 7,538,652 | B2 * | 5/2009 | Jenkins et al. | 336/200 |
| 7,602,264 | B2 * | 10/2009 | Itou et al. | 333/193 |
| 2007/0013462 | A1 * | 1/2007 | Fan | 333/185 |

* cited by examiner

*Primary Examiner*—Anh T Mai
(74) *Attorney, Agent, or Firm*—Muncy, Geissler, Olds & Lowe, PLLC

(57) ABSTRACT

A dual inductance structure including a substrate, a first inductance element, a second inductance element and a grounding element is provided. The substrate has a layout layer and a grounding layer. The first inductance element has a first and a second conductor. The second inductance element has a third and a fourth conductor. The grounding element has a first and a second grounding portion. The first grounding portion is on the grounding layer and located at an area between the first conductor and the third conductor. At least a part of the second grounding portion is on the grounding layer and located at an area between the first conductor and the second conductor. At least another part of the second grounding portion is on the grounding layer and located at an area between the third conductor and the fourth conductor.

13 Claims, 7 Drawing Sheets

DUAL INDUCTANCE STRUCTURE

This application claims the benefit of U.S. Provisional application Ser. No. 61/136,504, filed Sep. 10, 2008, and Taiwan application Serial No. 98104390, filed Feb. 11, 2009, the subject matter of which is incorporated herein by reference.

BACKGROUND OF THE INVENTION

1. Field of the Invention

The invention relates in general to an inductance structure, and more particularly to a dual inductance structure.

2. Description of the Related Art

Along with the growth in the industry of wireless communication, more and more communication products are developed and provided, and how to miniaturize electronic products to improve portability has become one of the objectives to achieve. Passive elements such as resistor, capacitor, and inductance of many communication products are implemented on an integrated circuit. When passive elements being integrated are used in an electronic device, a lot of space is saved.

Referring to both FIG. 1A and FIG. 1B. FIG. 1A shows a conventional structural diagram of a miniaturized bandpass filter. FIG. 1B shows an equivalent circuit diagram of the miniaturized bandpass filter in FIG. 1A. As indicated in FIG. 1A, the miniaturized bandpass filter 100 includes a conductor 102, a conductor 104, a conductor 106, a conductor 108 and a conductor 110, wherein the conductor 102 and conductor 104 are separated by a distance W1. The miniaturized bandpass filter 100 has an input port PORT1 and an output port PORT2. Referring to both FIGS. 1A and 1B at the same time. The conductor 102 can be equivalent to an inductance L1, and the conductor 104 can be equivalent to an inductance L2. The conductor 106 can be equivalent to a capacitor C1, the conductor 108 can be equivalent to a capacitor C2, and the conductor 110 can be equivalent to a capacitor Cp. The input port PORT1 corresponds to the input port P1 of the equivalent circuit, and the output port PORT2 corresponds to the output port P2 of the equivalent circuit. The inductance L1 and the inductance L2 have the effect of mutual inductance. As we may know that the smaller the distance W1 is separated the larger the mutual inductance is induced, we may have the mutual inductance value between the inductance L1 and the inductance L2 being increased. If the inductance element used in an electronic device requires a smaller mutual inductance value and maintains the respective self inductance value of the inductance L1 and the inductance L2 at the same time, the distance W1 needs to be increased. In this way, the smaller mutual inductance value may thus be obtained, but the circuit layout area may be increased and a large space of the electronic device may also be occupied. Thus, how to effectively reduce the miniaturized bandpass filter so as to save the space of electronic device has become an important subject for further research and development.

SUMMARY OF THE INVENTION

The invention is directed to a dual inductance structure, which reduces element size, saves the internal space of electronic device, and makes the electronic device easier to achieve the requirement of lightweight, slimness and compactness.

According to a first aspect of the present invention, a dual inductance structure including a substrate, a first inductance element, a second inductance element and a grounding element is provided. The substrate has a layout layer and a grounding layer. The first inductance element, disposed on the layout layer, has a first conductor and a second conductor which are connected with each other. The second inductance element, disposed on the layout layer, has a third conductor and a fourth conductor which are connected with each other, wherein the fourth conductor is adjacent to the second conductor. The grounding element, disposed on the grounding layer, has a first grounding portion and a second grounding portion which are connected with each other. The first grounding portion is located at an area of the grounding layer corresponding to an area between the first conductor and the third conductor. At least a part of the second grounding portion is located at an area of the grounding layer corresponding to an area between the first conductor and the second conductor. At least another part of the second grounding portion is located at an area of the grounding layer corresponding to an area between the third conductor and the fourth conductor.

The invention will become apparent from the following detailed description of the preferred but non-limiting embodiments. The following description is made with reference to the accompanying drawings.

DETAILED DESCRIPTION OF THE INVENTION

The invention discloses a dual inductance structure including a substrate, a first inductance element, a second inductance element and a grounding element. The substrate has a layout layer and a grounding layer. The first inductance element is disposed on the layout layer and has a first conductor and a second conductor which are connected with each other. The second inductance element is disposed on the layout layer and has a third conductor and a fourth conductor which are connected with each other, wherein the fourth conductor is adjacent to the second conductor. The grounding element is disposed on the grounding layer and has a first grounding portion and a second grounding portion which are connected with each other. The first grounding portion is located at an area of the grounding layer corresponding to an area between the first conductor and the third conductor. At least a part of the second grounding portion is located at an area of the grounding layer corresponding to an area between the first conductor and the second conductor, and at least another part of the second grounding portion is located of the grounding layer corresponding to an area at an area between the third conductor and the fourth conductor.

Figure 2:
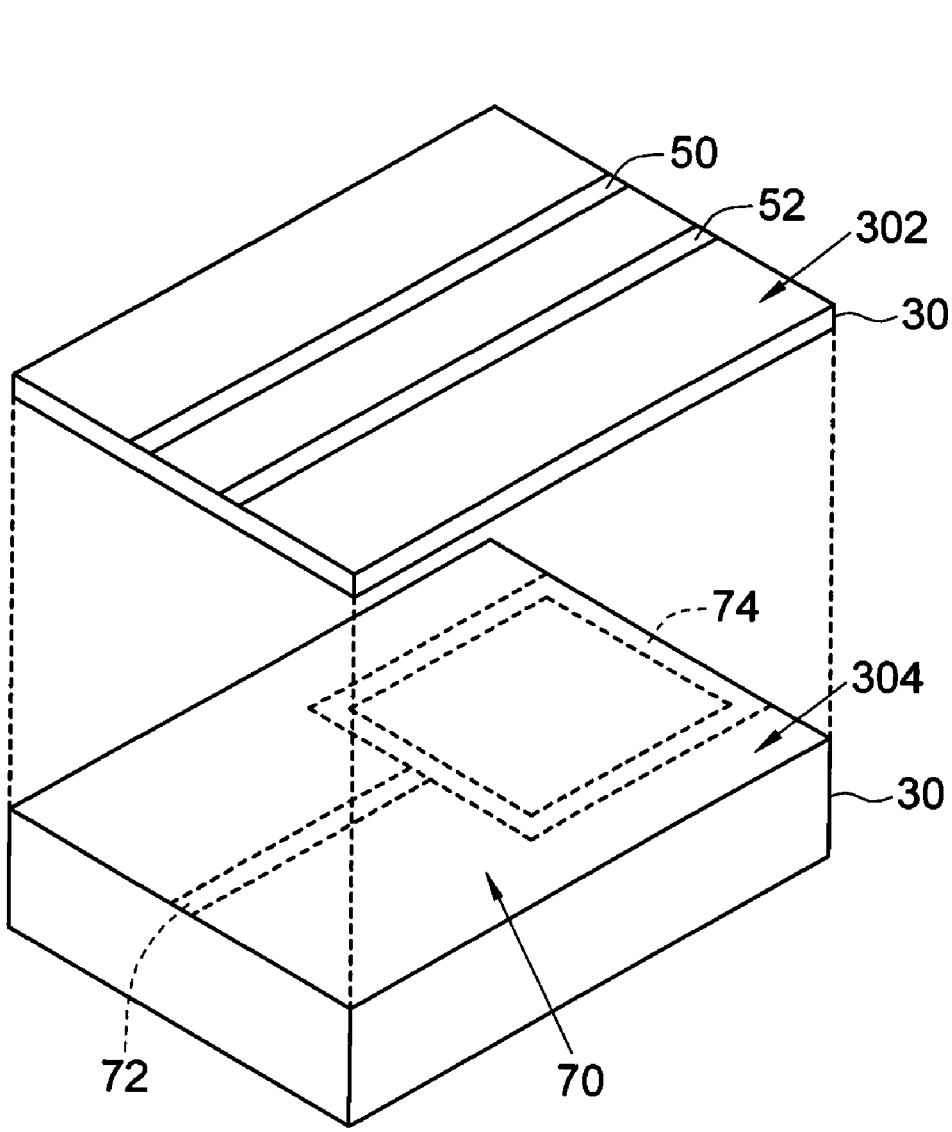
FIG. 2 shows a structural diagram of a dual inductance structure according to an embodiment of the invention.

Referring to FIG. 2, a structural diagram of a dual inductance structure according to an embodiment of the invention is shown. The dual inductance structure 10 includes a substrate 30, a first inductance element 50, a second inductance element 52 and a grounding element 70. The substrate 30 has a layout layer 302 and a grounding layer 304. The first inductance element 50 is disposed on the layout layer 302 of the substrate 30. The second inductance element 52 is disposed on the layout layer 302 of the substrate 30. The grounding element 70 is disposed on the grounding layer 304 and has a first grounding portion 72 and a second grounding portion 74, wherein the first grounding portion 72 and the second grounding portion 74 are connected with each other.

Figure 3:
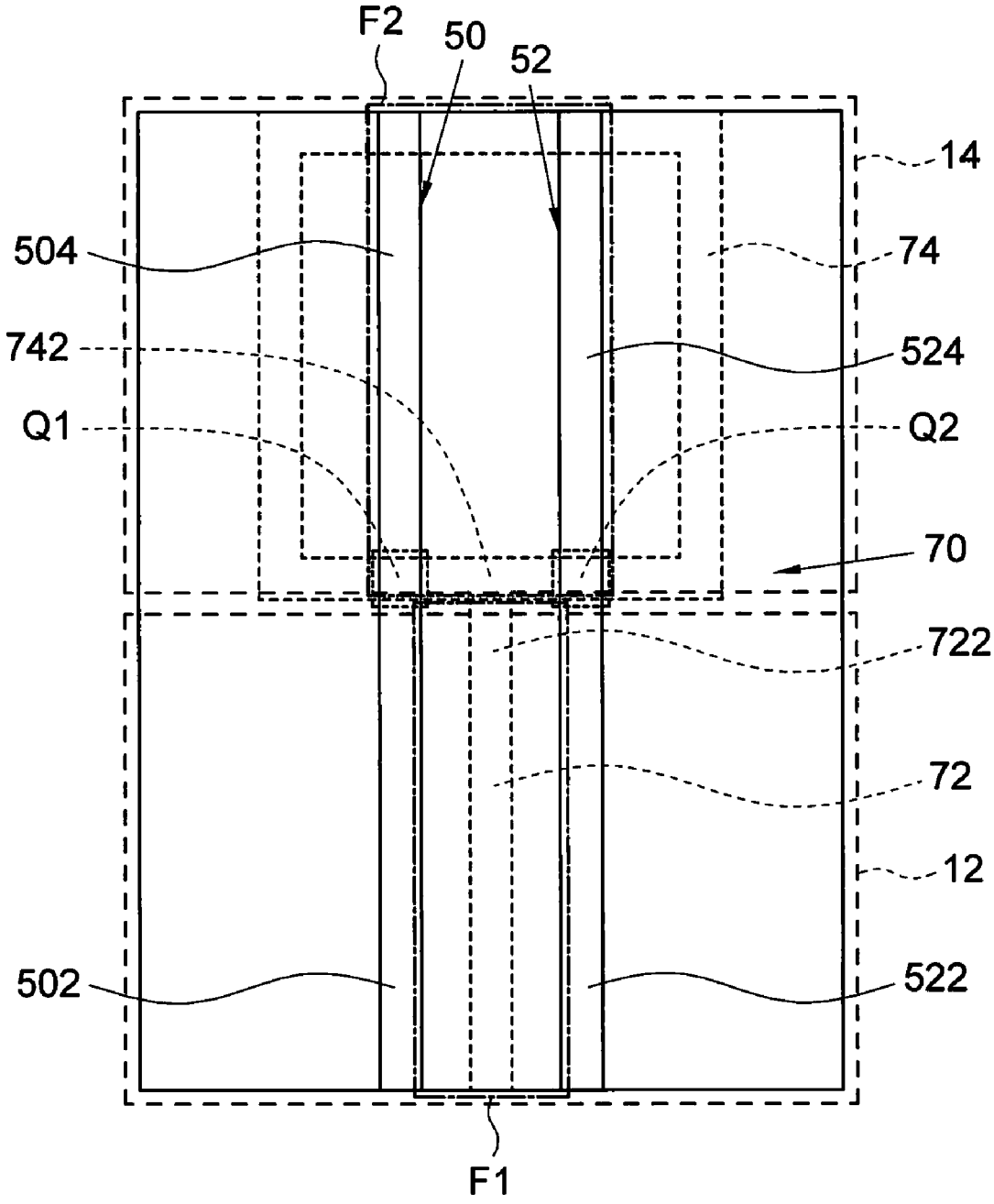
FIG. 3 shows a top view of the dual inductance structure in FIG. 2.

Referring to FIG. 3, a top view of the dual inductance structure in FIG. 2 is shown. Referring to both FIG. 2 and FIG. 3, the first inductance element 50 has a first conductor 502 and a second conductor 504, wherein the first conductor 502 and the second conductor 504 are connected with each other. The second inductance element 52 has a third conductor 522 and a fourth conductor 524, which are connected with each other, and the fourth conductor 524 is adjacent to the second conductor 504. The first grounding portion 72 is located at an area of the grounding layer corresponding to an area F1, which is between the first conductor 502 and the third conductor 522. At least a part of the second grounding portion 74 is located at an area of the grounding layer corresponding to an area Q1, which is between the first conductor 502 and the second conductor 504, and an area Q2, which is between the third conductor 522 and the fourth conductor 524.

Figure 4:
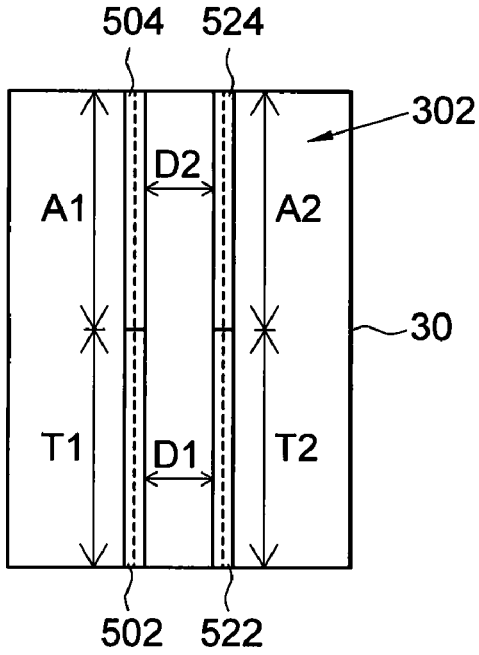
FIG. 4 shows a first inductance element and a second inductance element in FIG. 3.
Figure 5:
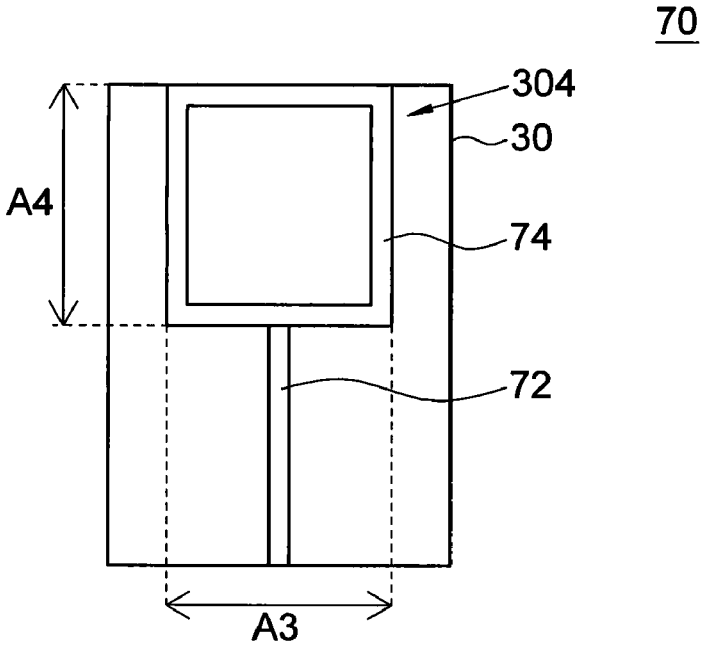
FIG. 5 shows a grounding element in FIG. 3.

Referring to FIG. 3, FIG. 4 and FIG. 5 at the same time. FIG. 4 shows a first inductance element 50 and a second inductance element 52 in FIG. 3. FIG. 5 shows a grounding element 70 in FIG. 3. The first conductor 502 and the second conductor 504 of the first inductance element 50 as well as the third conductor 522 and the fourth conductor 524 of the second inductance element 52 each have substantially a bar structure disposed on the layout layer 302 of the substrate 30, wherein the first conductor 502 corresponds to the third conductor 522, and the second conductor 504 corresponds to the fourth conductor 524. Preferably, the first conductor 502 is substantially parallel to the third conductor 522, and the second conductor 504 is substantially parallel to the fourth conductor 524. The first conductor to the fourth conductor 502, 504, 522, and 524 are exemplified by a bar structure in the present embodiment of the invention. However, the invention is not limited thereto, and the first conductor or the third conductor can have a spiral structure or any other structure.

The first grounding portion 72 having substantially a strip structure is deposited on the grounding layer 304, and is located at an area corresponding to the area F1 between the first conductor 502 and the third conductor 522. The second grounding portion 74 having substantially a ring structure is deposited on the grounding layer 304, and is located at the area corresponding to an area F2 between the second conductor 502 and the fourth conductor 522. As indicated in FIG. 3, a part 742 of the second grounding portion 74 is on the grounding layer 304 and located at the area corresponding to the area Q1, which is between the first conductor 502 and the second conductor 504, and the area Q2, which is between the third conductor 522 and the fourth conductor 524, and is connected to one end 722 of the first grounding portion 72 with each other.

The grounding element 70 is disposed on the grounding layer 304 of the substrate 30, and divides the area on which the first inductance element 50 and the second inductance element 52 are disposed into an area 12 and an area 14. The first conductor 502, the third conductor 522 and the first grounding portion 72 are located in the area 12. Because the first grounding portion 72 is grounded and located between the first conductor 502 and the third conductor 522, the grounding voltage provided by the first grounding portion 72 will make the mutual inductance between the first inductance element 50 and the second inductance element 52 become insignificant. The second conductor 504, the fourth conductor 524 and the second grounding portion 74 are located in the area 14, wherein the second grounding portion 74 is grounded and surrounds the second conductor 504 and the fourth conductor 524. Because the second grounding portion 74 provides the grounding voltage and surrounds the second conductor 504 and the fourth conductor 524, the mutual inductance between the second conductor 504 and the fourth conductor 524 is independent and is not affected by the first conductor 502 and the third conductor 522. Thus, the mutual inductance between the first inductance element 50 and the second inductance element 52 is almost determined by the mutual inductance between the second conductor 504 and the fourth conductor 524. Each of the second conductor 504 and the fourth conductor 524 has a self inductance. Examples will be made in the following for illustration.

The first inductance element L1 has a first predetermined inductance L1, and the first conductor 502 and the second conductor 504 respectively have an inductance value L1*a* and an inductance value L1*b*, wherein L1*a*+L1*b*=L1. The second inductance element L2 has a second predetermined inductance L2, and the third conductor 522 and the fourth conductor 524 respectively have an inductance value L2*a* and an inductance value L2*b*, wherein L2*a*+L2*b*=L2. Because the first grounding portion 72 is grounded and located between the first conductor 502 and the third conductor 522, the first conductor 502 and the third conductor 522 generate a mutual inductance effect satisfies with the equation Lm1≅0. Because the second grounding portion 74 is grounded and surrounds the second conductor 504 and the fourth conductor 524, the mutual inductance Lm2 generated from the second conductor 504 and the fourth conductor 524 is not equal to 0, but satisfies with the equation $$Lm2 = K\sqrt{L2a * L2b},$$

where K is a mutual inductance effect coefficient. Thus, the mutual inductance Lm being predetermined can thus be satisfied, that is, Lm2≅Lm, where the mutual inductance Lm2 is not affected by the first conductor 502 and the third conductor 522.

However, the second grounding portion of the grounding element in the present embodiment is not limited to have a ring structure, it may also be designed to have a bar structure. For example, the second grounding portion may only have a part 742 of the second grounding portion 74 in the present embodiment, so as to make the grounding element substantially have a T-shaped structure.

Referring to FIG. 3, FIG. 4 and FIG. 5 at the same time. The first conductor 502 and the third conductor 522 are separated by a distance D1. The second conductor 504 has a first length A1 and is separated from the fourth conductor 524 by a distance D2. The fourth conductor 524 has a second length A2. The first length A1 and the second length A2 are respectively related to the self inductances of the second conductor 504 and the fourth conductor 524, and are substantially related to the mutual inductance value between the first inductance element 50 and the second inductance element 52. The distance D2 is also related to the mutual inductance value between the first inductance element 50 and the second inductance element 52. The second grounding portion 74 has a width A3 and a length A4. The width A3 is preferably larger than the distance D2 between the second conductor 504 and the fourth conductor 524. The length A4 is preferably larger than or equal to the first length A1 of the second conductor 504 and the second length A2 of the fourth conductor 524. Preferably, the distance D1 between the first conductor 502 and the third conductor 504 is substantially equal to the distance D2 between the second conductor 522 and the fourth conductor 524.

Figure 1A:
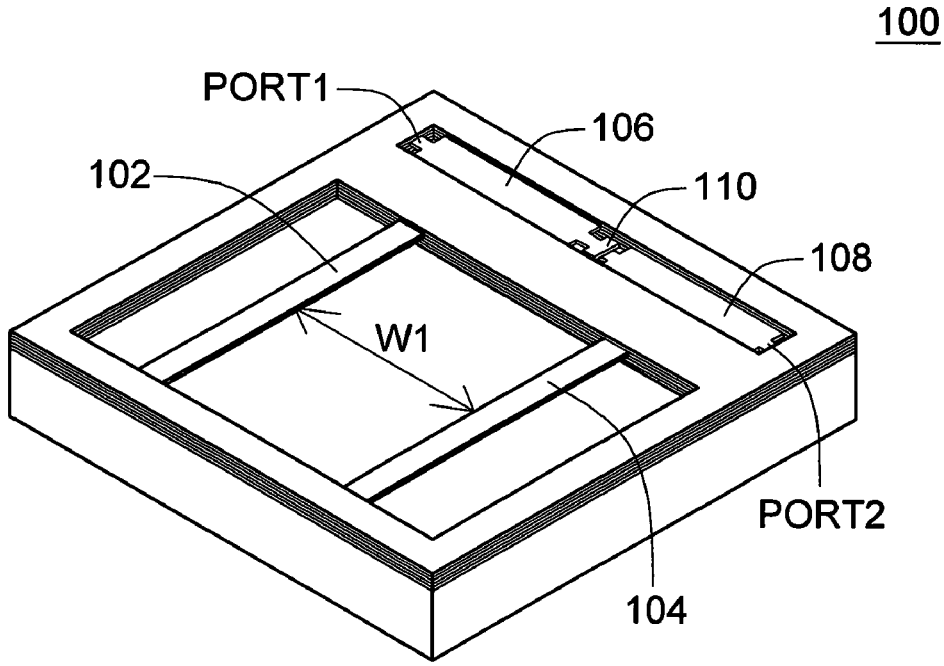
FIG. 1A(PRIOR ART)
FIG. 1A (prior art) shows a structural diagram of a miniaturized bandpass filter.
Figure 1B:
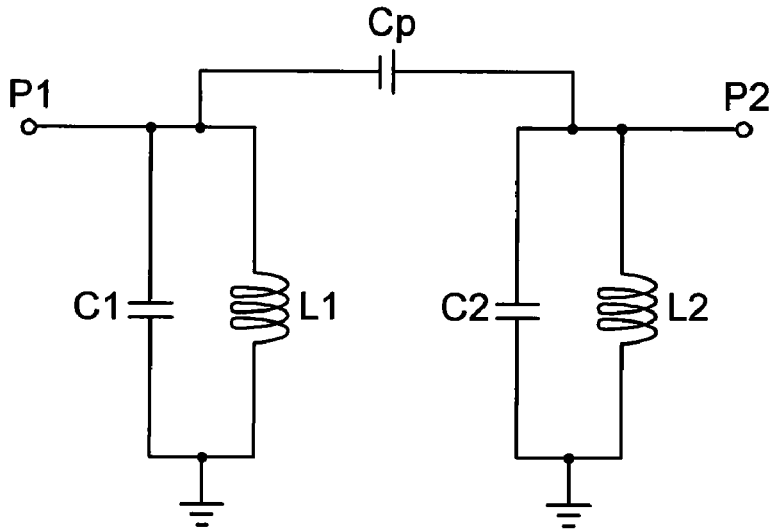
FIG. 1B(PRIOR ART)
FIG. 1B (prior art) shows an equivalent circuit diagram of the miniaturized bandpass filter in FIG. 1A.
Figure 6:
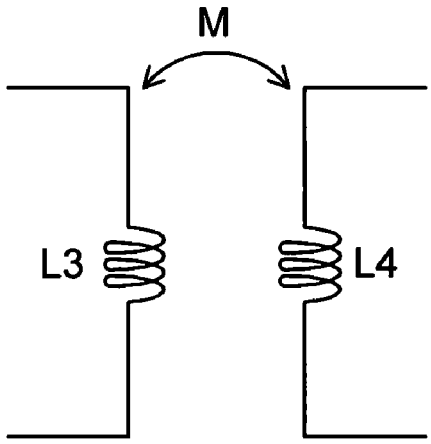
FIG. 6 shows an equivalent circuit diagram of the dual inductance structure in FIG. 2.

Referring to FIG. 6, an equivalent circuit diagram of the dual inductance structure in FIG. 2 is shown. Referring to both FIG. 3 and FIG. 4, the first inductance element 50 can be equivalent to inductance L3, the second inductance element 52 can be equivalent to an inductance L4. The mutual inductance value between the first inductance element 50 and the second inductance element 52 is M. The mutual inductance value M is related to the distance D2. According to the prior arts indicated in FIG. 1A, in the miniaturized bandpass filter 100, if a smaller mutual inductance value is need and the self inductance of the inductances L1 and L2 is need to be maintained at the same time, it is needed to increase the distance W1 to reduce the mutual inductance between the inductance L1 and the inductance L2 so as to obtain a reduced mutual inductance value. However, the above practice increases the area of the circuit layout and reduces the available space of electronic device. In this embodiment, the mutual inductance value M between the first inductance element 50 and the second inductance element 52 of the dual inductance structure is substantially determined by the second conductor 504 and the fourth conductor 524. Thus, the mutual inductance value M can be reduced by directly shortening the length A1 of the second conductor 504 and the length A2 of the fourth conductor 524 without increasing the distance D2. That is, the length A4 of the second grounding portion 74 is shortened. Compared with the prior art as indicated in FIG. 1A, the present embodiment can obtain the same level of mutual inductance value with a reduced distance D2, hence reducing the required area and increasing the available space of an electronic device. Besides, the required inductance value can be easily adjusted. For example, the self inductances of the first inductance element 50 and the second inductance element 52 can be flexibly adjusted by way of adjusting the length T1 of the first conductor 502 and the length T2 of the third conductor 522, respectively. Thus, the dual inductance structure 10 has wider application.

Figure 7:
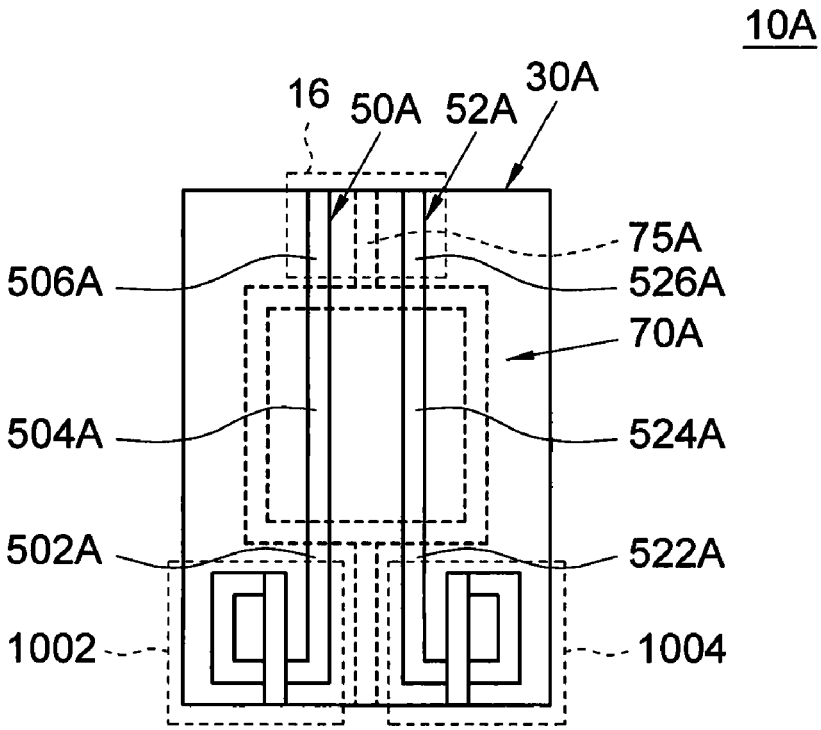
FIG. 7 shows a dual inductance structure of another embodiment of the invention.

Referring to FIG. 7, a dual inductance structure of another embodiment of the invention is shown. The dual inductance structure 10A includes a substrate 30A, a first inductance element 50A, a second inductance element 52A and a grounding element 70A. The first inductance element 50A has a first conductor 502A and a second conductor 504A. The second inductance element 52A has a third conductor 522A and a fourth conductor 524A. FIG. 7 differs with FIG. 2 in that a part of the first conductor 502A and the third conductor 522A each substantially have a spiral structure. For example, a part 1002 of the first conductor 502A and a part 1004 of the third conductor 522A each have substantially a spiral structure or even a structure of any other shapes. Through the design of several turnings, the overall lengths of the first conductor 502A and the third conductor 522A are respectively increased so as to increase or reduce the equivalent inductance value of the dual inductance structure 10A, especially the equivalent self inductance. Besides, the structure in this embodiment also saves the area occupied by the dual inductance structure 10A.

Another difference between the dual inductance structure of the present embodiment and the dual inductance structure 10 in FIG. 2 is as follows. The dual inductance structure 10A further includes a fifth conductor 506A of the first inductance element 50A, a sixth conductor 526A of the second inductance element 52A, and an extension portion 75A of the grounding element 70A. The fifth conductor 506A, the sixth conductor 526A, and the extension portion 75A of the grounding element 70A are located in the area 16. The area 16 substantially generates the same effect as that generated by the area 12 of FIG. 3, which is not repeated here. Thus, the area 16 can be used for increasing the equivalent inductance value of the dual inductance structure 10A, especially the equivalent self inductance.

Figure 8A:
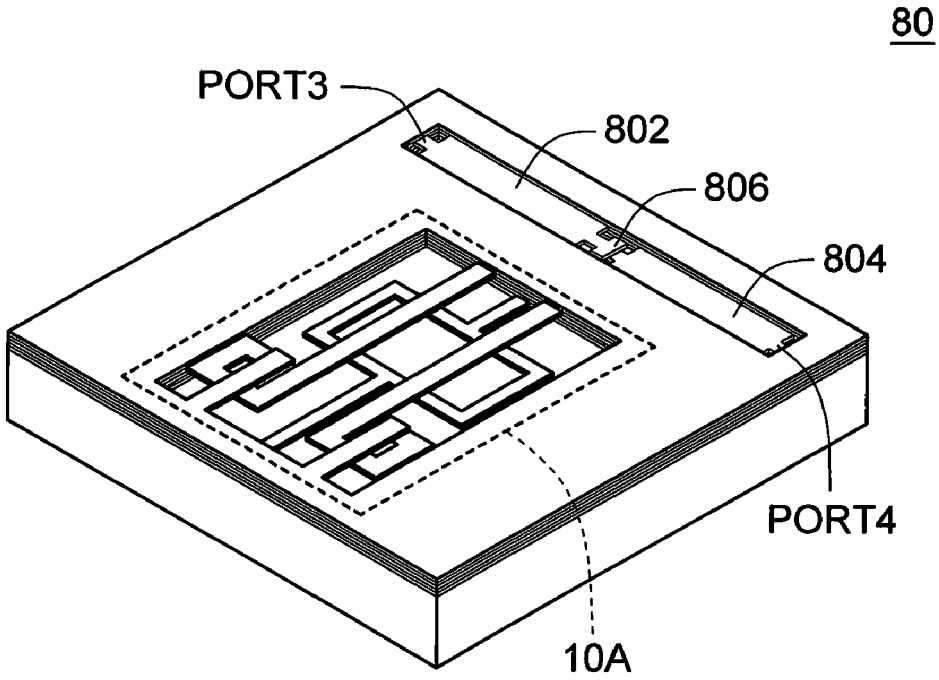
FIG. 8A shows a structural diagram of a dual inductance structure being applied in a miniaturized bandpass filter.
Figure 8B:
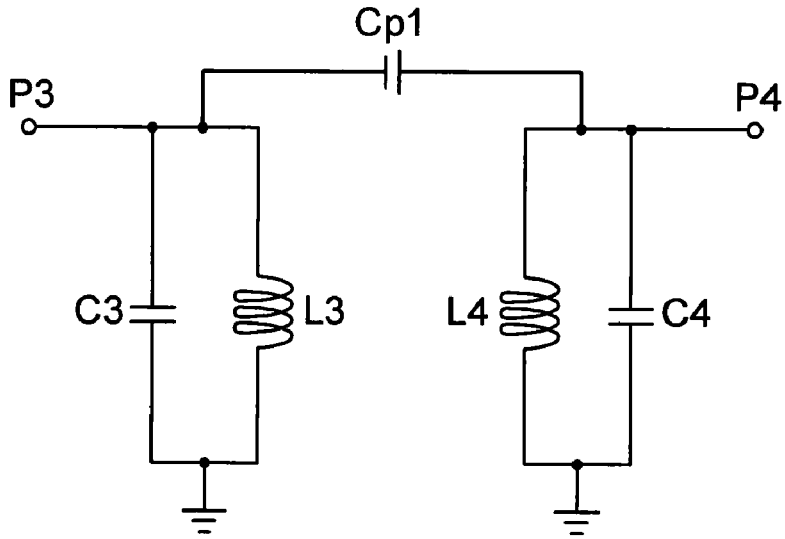
FIG. 8B shows an equivalent circuit diagram of the miniaturized bandpass filter in FIG. 8A.

Referring to both FIG. 8A and FIG. 8B. FIG. 8A shows a structural diagram of a dual inductance structure being applied in a miniaturized bandpass filter. FIG. 8B shows an equivalent circuit diagram of the miniaturized bandpass filter of FIG. 8A. As indicated in FIG. 8A, the miniaturized bandpass filter 80 includes a dual inductance structure 10A, an input port PORT3, an output port PORT4, a conductor 802, a conductor 804 and a conductor 806. In this miniaturized bandpass filter, the conductor 802 is equivalent to the capacitor C3, the conductor 804 is equivalent to the capacitor C4, the conductor 806 is equivalent to the capacitor Cp1, the input port PORT3 is equivalent to the input port P3, and the output port PORT4 is equivalent to the output port P4.

Figure 8C:
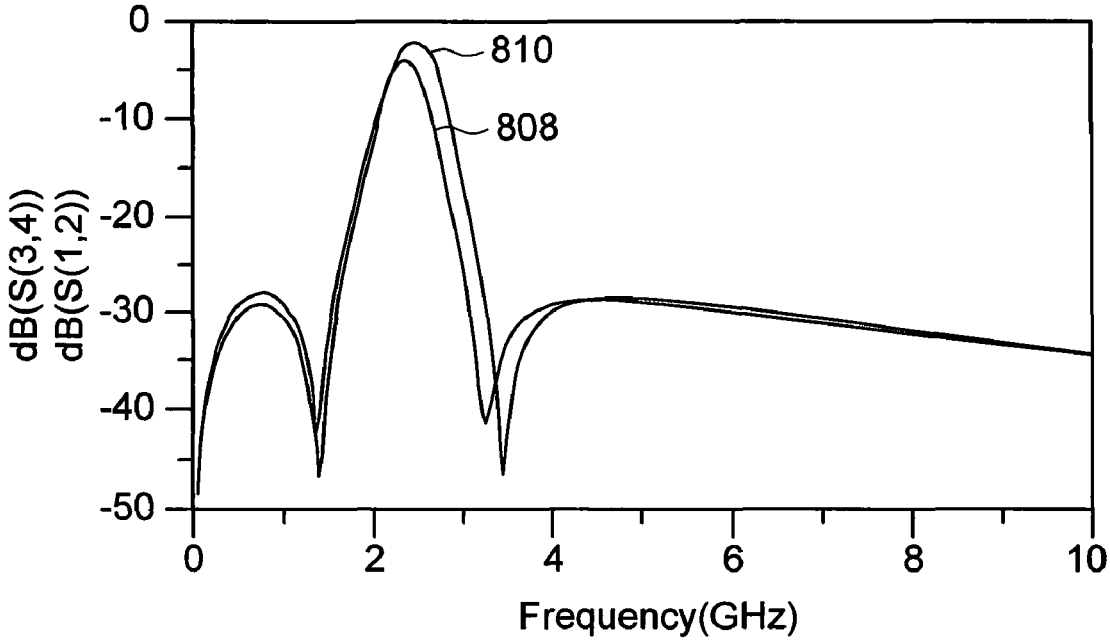
FIG. 8C shows the result simulating insertion loss of the miniaturized bandpass filter in FIG. 8A and FIG. 1A.

Referring to FIG. 8C, the result simulating insertion loss of the miniaturized bandpass filter in FIG. 8A and FIG. 1A is shown. As indicated in FIG. 8C, around the frequency of 2.45 GHz, the curve 808 of insertion loss S(3,4) of the miniaturized bandpass filter is close to the curve 810 of insertion loss S(1,2) of the miniaturized bandpass filter, wherein 1 to 4 denote PORT1 to PORT4, respectively. Compared with the miniaturized bandpass filter of the prior art as indicated in FIG. 1A, the miniaturized bandpass filter of the embodiment not only achieves a similar bandpass effect, but also reduces the area of the circuit layout.

Figure 9:
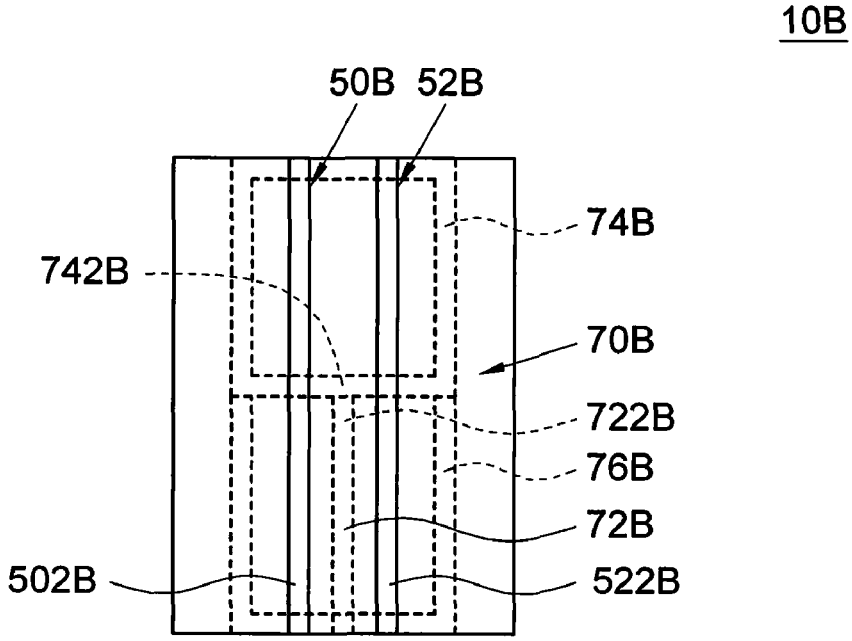
FIG. 9 shows a dual inductance structure of yet another embodiment of the invention.

Referring to FIG. 9, a dual inductance structure of yet another embodiment of the invention. The dual inductance structure 10B includes a first inductance element 50B, a second inductance element 52B and a grounding element 70B. The grounding element 70B includes a first grounding portion 72B and a second grounding portion 74B. FIG. 9 differs with FIG. 2 in that the grounding element 70B further includes a third grounding portion 76B, which is connected to a part 742B of the second grounding portion 74B and surrounds the first conductor 502B and the third conductor 522B. If the dual inductance structure 10B of the present embodiment is disposed in an environment where the dual inductance structure 10B is surrounded by other elements, this embodiment can prevent the dual inductance structure 10B from being electrically interferenced by other elements. Also, in this embodiment, the first conductor 502B of the first inductance element 50B and the third conductor 524B of the second inductance element 52B each can also have a spiral structure as well.

The dual inductance structure of the invention reduces the layout area and enables the electronic device using the same to achieve the objectives of lightweight, slimness and compactness, so that the market competitiveness thereof can thus be increased.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dual inductance structure, comprising:

a substrate having a layout layer and a grounding layer;

a first inductance element disposed on the layout layer, wherein the first the inductance element has a first conductor and a second conductor which are connected with each other; and a second inductance element disposed on the layout layer having a third conductor and a fourth conductor which are connected with each other, wherein the fourth conductor is adjacent to the second conductor, wherein, the grounding layer comprising a grounding element, wherein the grounding element has a first grounding portion and a second grounding portion which are connected with each other, the first grounding portion is located at an area of the grounding layer corresponding to an area between the first conductor and the third conductor, at least a part of the second grounding portion is located at an area of the grounding layer corresponding to an area between the first conductor and the second conductor, and at least another part of the second grounding portion is located at an area of the grounding layer corresponding to an area between the third conductor and the fourth conductor.

2. The dual inductance structure according to claim 1, wherein the second grounding portion is substantially ring-shaped, and the second grounding portion surrounds the area of the grounding layer corresponding to the second conductor and the fourth conductor.

3. The dual inductance structure according to claim 1, wherein a part of the first conductor and a part of the third conductor are substantially spiral-shaped.

4. The dual inductance structure according to claim 1, wherein the second conductor, the fourth conductor and the first grounding portion are substantially strip-shaped.

5. The dual inductance structure according to claim 1, wherein the grounding element further comprises a third grounding portion surrounding the area of the grounding layer corresponding to the first conductor and the third conductor.

6. The dual inductance structure according to claim 1, wherein the first conductor corresponds to the third conductor, and the second conductor corresponds to the fourth conductor.

7. The dual inductance structure according to claim 6, wherein the first conductor is substantially parallel to the third conductor, and the second conductor is substantially parallel to the fourth conductor.

8. The dual inductance structure according to claim 7, wherein the distance between the first conductor and the third conductor is substantially equal to that between the second conductor and the fourth conductor.

9. The dual inductance structure according to claim 1, wherein the mutual inductance value between the first inductance element and the second inductance element substantially depends on a distance, which is between the second conductor and the fourth conductor, and a length, which each the second conductor and the fourth conductor has.

10. The dual inductance structure according to claim 9, wherein the distance is inversely proportional to the mutual inductance value between the first inductance element and the second inductance element, and the length is directly proportional to the mutual inductance value between the first inductance element and the second inductance element.

11. The dual inductance structure according to claim 1, wherein the self inductance, which each the first inductance element and the second inductance element has, depends on a length, which each the first inductance element and the second inductance element has.

12. The dual inductance structure according to claim 11, wherein the self inductance, which each the first inductance element and the second inductance element has, is directly proportional to the length, which each the first inductance element and the second inductance element has.

13. The dual inductance structure according to claim 1, wherein, the first inductance element has a first predetermined inductance L1, the first conductor and the second conductor respectively have an inductance value L1*a* and an inductance value L1*b*, where L1*a*+L1*b*=L1;

the second inductance element has a second predetermined inductance L2, the third conductor and the fourth conductor respectively have an inductance value L2*a* and an inductance value L2*b*, where L2*a*+L2*b*=L2;

the first conductor and the third conductor generate a mutual inductance Lm1≅0; and the second conductor and the fourth conductor generate a mutual inductance $$Lm2 = K\sqrt{L2a * L2b},$$

where K is a mutual inductance effect coefficient which satisfies with the mutual inductance Lm being predetermined, that is, Lm2≅Lm.

* * * * *